United States Patent [19]

Vollendorf

[11] 4,318,543

[45] Mar. 9, 1982

[54] POOL TABLE CONVERSION INSERTS

[76] Inventor: Howard A. Vollendorf, 360 S. Elwood, Glendora, Calif. 91740

[21] Appl. No.: 110,239

[22] Filed: Jan. 7, 1980

[51] Int. Cl.[3] ..... A63D 15/00

[52] U.S. Cl. ..... 273/4 A

[58] Field of Search ..... 220/235, 237, 238, 233, 220/234; 273/4 A, 4 B, 12, 9

[56] References Cited

U.S. PATENT DOCUMENTS

| | | | |
|---|---|---|---|
| 328,092 | 10/1885 | Waggoner | 273/4 A |
| 1,894,989 | 1/1933 | Hansen | 273/4 A |
| 3,156,373 | 10/1964 | Willis | 220/237 |
| 3,451,541 | 6/1969 | Passo | 220/238 |
| 4,095,786 | 6/1978 | Foley | 273/4 A |

*Primary Examiner*—Richard C. Pinkham
*Assistant Examiner*—T. Brown
*Attorney, Agent, or Firm*—Boniard I. Brown

[57] ABSTRACT

Inserts for converting a pool table into a billiard table or a crap table. The inserts each include a plug portion which fits in a pocket of the pool table and a connected rail completing portion. The plug is split vertically and includes a spreader element for spreading the split therein for snug sideward abutment with the pocket.

13 Claims, 5 Drawing Figures

Fig. 1
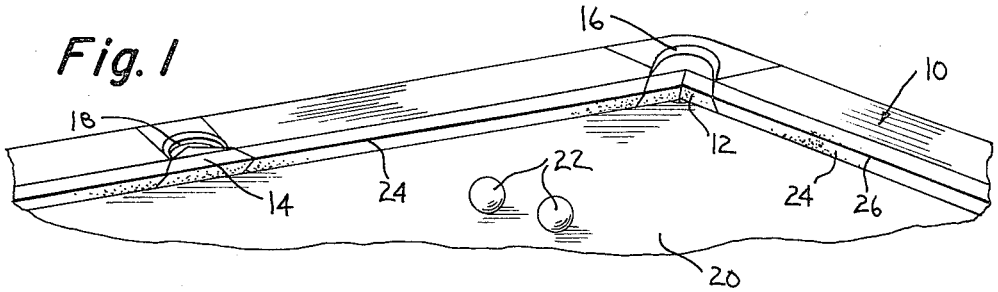
Fig. 2
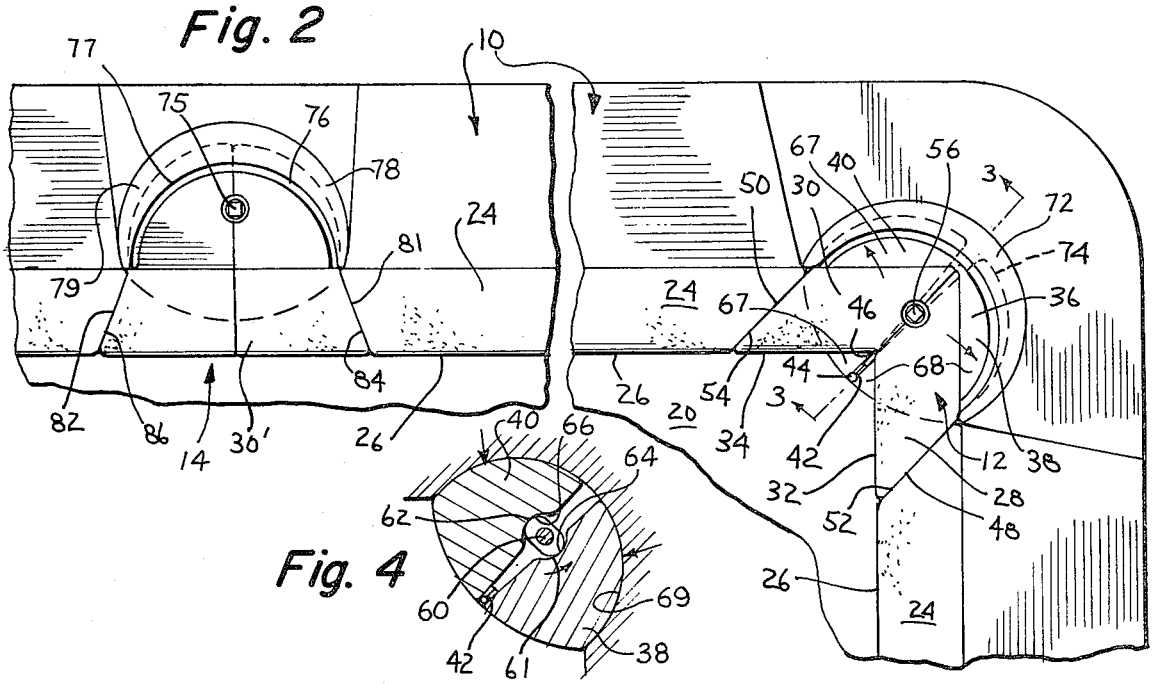
Fig. 4
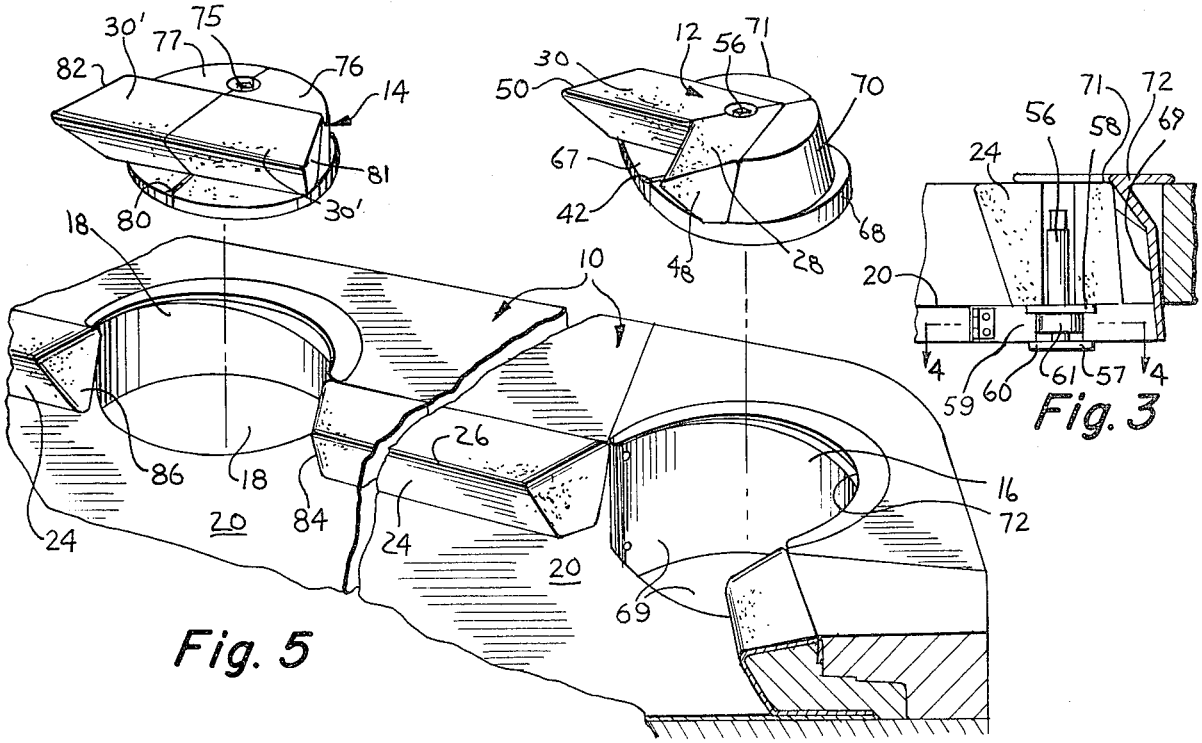
Fig. 5

POOL TABLE CONVERSION INSERTS

BACKGROUND OF THE INVENTION

Many plugs and other devices for converting pool tables into tables having a continuous rail, such as billiard tables and crap tables are known in the art. Examples can be seen in U.S. Pat Nos. 241,943 and 292,547 to DOCKSTADER; U.S. Pat. No. 328,092 to WAGGONER; U.S. Pat. No. 767,309 to McGEE; U.S. Pat. No. 980,142 to BYNER; U.S. Pat. No. 1,894,989 to HANSEN and U.S. Pat. No. 4,010,949 to LEE. Most of the prior art devices cannot be slipped in and out simply but instead require relatively complex manipulation of some sort of holding mechanism. The installation of some of the plugs disclosed in the prior art require a hole or holes be drilled in the existing table at each pocket for receiving a rod which extends sidewardly from the plug.

To convert a pool table into a billiard table or a crap table, it is necessary to extend the rails thereof across the pockets. For billiards it is necessary to entirely plug the pockets so that a continuous ball engaging cushion exists around the perimeter of the table. When the rail is extended it is important that the rail portions filling the pockets have similar properties and characteristics as the permanent rail, since otherwise balls impacting thereon will act in a manner inconsistent with what is normally expected from the table. To produce the similar properties, the plug or insert containing the rail must be rigidly supported and maintain the rail in longitudinal and lateral alignment with other rail portions.

BRIEF DESCRIPTION OF THE PRESENT INVENTION

In the present invention, an insert unit is provided for placement in the pockets or holes of a pool table to convert the table for use as a billiard or crap table, and for this reason devices constructed according to the invention are adapted for use either in corner pockets or in side pockets of pool tables. For use in a corner pocket, the insert device is configured with a two part plug which engages the bumper portion of the pocket frictionally when spread by mechanical means such as a spring or cam. At the same time, a flange engages the perimeter of the pocket below the bumper portion to maintain the plug in proper alignment within the pocket and to extend the table surface thereby eliminating the pocket opening. The front portion of each part of the corner plug includes a rail portion with the rail portions being oriented at 90° to each other. The rail portions are extended sidewardly into the adjacent rail portions of the pool table when the plug is inserted and spread by the cam, to snugly fit therebetween. They extend the rail almost to the corner, the corner split not being important since the diameter of the ball prevents contact with the exact split corner of the plug. For the plugging of side pockets, essentially the same device is provided except that a single rail extension is provided, the elastic material in the rail and the cloth thereover accommodating the split of the plug so that a one piece rail extension which is firmer than a two piece embodiment can be utilized.

It therefore is an object of the present invention to provide means for converting a pool table into a table having a continuous rail and no pockets so that billiards can be played on the table or craps can be shot on the table without losing the dice down the prockets.

Another object is to provide pool table to billiard table conversion means which are easily constructed, can be quickly inserted in or removed from the table, and which when inserted act as though a solid rail was present.

These and other objects and advantages of the present invention will become apparent to those skilled in the art after considering the following detailed specification in conjunction with the accompanying drawing wherein:

BRIEF DESCRIPTION OF THE DRAWINGS

FIG. 1 is a perspective view of a portion of a pool table having pocket plugs constructed according to the present invention installed in the side and corner pockets thereof;

FIG. 2 is a top plane view of the table portion of FIG. 1;

FIG. 3 is a cross-sectional view taken at line 3—3 in FIG. 2;

FIG. 4 is a detailed cross-sectional view taken at line 4—4 in FIG. 3 showing a typical cam operated split extending mechanism for the present invention; and FIG. 5 is an enlarged exploded view showing how the plug inserts of the present invention extend within the pockets of a pool table.

DETAILED DESCRIPTION OF THE SHOWN EMBODIMENTS

Referring to the drawing more particularly by reference numbers, number 10 in FIG. 1 refers to a pool table having inserts 12 and 14 constructed according to the present invention in the corner and side pockets 16 and 18 thereof respectively. The table 10 includes a table surface 20 on which balls 22 are caused to move. The balls 22 are restricted in their movements on the table surface 20 by rails 24 which extend around the table 10 except for openings for the corner and side pockets 16 and 18. The rails 24 are generally trapezoidal in cross-sectional shape, they having a ball impact edge 26 whose height above the table surface 20 is specifically chosen to impart the desired motion to balls 22 striking thereagainst.

When the inserts 12 and 14 of the present invention are inserted into the pockets 16 and 18 of the table 10, it is important that the rails 24 adjacent the pockets 16 and 18 be extended as though they were solid so that a ball 22 impacting thereagainst will act as though it had struck the elastic edge 26 of a solid rail 24. For this reason, the corner insert 12 includes a pair of elastic rail inserts 28 and 30 having impact edges 32 and 34 respectively which are held in alignment both vertically and horizontally with the edges 26 of the adjacent rails 24. This is accomplished by providing a support for the rail inserts 28 and 30 which is a plug 36, split in two portions 38 and 40. These two portions 38 and 40 are connected by means of a hinge 42 centrally therebetween at what is the inward edge 44 thereof when inserted in the pocket 16 of the pool table 10. The hinge 42 is spaced from the 90° corner 46 between the rail inserts 28 and 30 a horizontal distance less than the distance of the radius of a ball 22 so that the hinge 42 does not interfere with the proper rolling action of a ball 22 impacting in the corner 46. The rail inserts 28 and 30 are trapezoidally shaped in horizontal planform, having outer edges 48 and 50 which engage the opening edges 52 and 54 of a corner pocket 16. The engagement between the outer edges 48 and 50 and the edges 52 and 54 is forcefully maintained by suitable split spreading means such as the cam 56 shown in FIGS. 3 and 4. The cam 56 is centrally supported by flanges 57 and 58 integral therewith which entrap a portion 59 of each portion 38 and 40 so the cam 56 is retained between the two split portions 38 and 40. When the cam 56 is rotated such as by means of the screwdriver slot 60, the two lobes 61 and 62 of the cam 56 engage a pair of semicircular cam follower surfaces 64 and 66 of the portions 38 and 40 to force them apart and to jam the flange portions 67 and 68 into the pocket periphery 69. The back upper portions 70 and 71 of the portions 38 and 40 are frustro-conical in shape and engage the bumper 72 of the pocket 16 at the same time to provide a firm support for the corner insert 12.

The side insert 14 operates essentially in the same manner with a similar cam 75, split portions 76 and 77, flange portions 78 and 79 and hinge 80 therebetween except that the rail insert 30' thereof may be a solid one-piece elastic structure. When the portions 76 and 77 of the inset 14 are spread by the cam 75, the insert 30 with its cover is resilient enough to accommodate the slight movement required to lock the side insert 14 within the side pocket 18. The rail insert 30 is trapezoidal in horizontal planform, it having a pair of side surfaces 81 and 82 which engage the side surfaces 84 and 86 respectively of the rail 24 adjacent the side pocket 18.

Thus there has been shown and described novel means for conversion of a pool table so that pool, billiards or craps can be played thereon which fulfills all the objects and advantages sought therefor. Many changes, alterations, variations and other uses and applications of the subject invention will however become apparent to those skilled in the art after considering this specification. All such changes, modifications, variations and other uses and applications which do not depart from the spirit and scope of the invention are deemed to be covered by the invention which is limited only by the claims which follow.

What is claimed is:

1. An insert for plugging the pocket of a pool table and extending the rail thereacross so that games such as billiards and craps can be played on the top thereof between the rails thereof, said insert including:

first and second body portions, said first body portion having a first lower flange portion and said second body portion having a second lower flange portion;

at least one filler rail portion connected at least to said first body portion;

hinge means connecting said first and second body portions together for relative pivoting movement therebetween; and spreader means connected between said first and second body portions to pivot said first and second body portions apart about said hinge means to force said first and second lower flanges into the pocket and thereby removably retain said insert therein.

2. The insert as defined in claim 1 wherein said first and second flanges include upper surface portions which are in general alignment with the pool table top when said insert is being retained in said pocket and extend the top of said filler rail portion, said hinge means being positioned adjacent said upper surface portions of said first and second flanges.

3. The insert as defined in claim 2 wherein said spreader means include:

a cam supported between said first and second body portions; and cam follower surfaces on said first and second body portions positioned to be engaged by said cam, whereby the rotation of said cam spreads said first and second body portions about said hinge means.

4. The insert as defined in claim 3 wherein said filler rail portion is resilient and connected to both said first and second body portions, the resiliency thereof accommodating said pivoting of said first and second body portions.

5. The insert as defined in claim 4 wherein said first and second body portions include upper frustro-conical portions positioned behind said filler rail portion so said upper frustro-conical portions can engage the bumper of the pocket when said insert is placed therein.

6. The insert as defined in claim 2 wherein first and second filler rail portions are included, said first filler rail portion being connected to said first body portion and said second filler rail portion being connected to said second body portion positioned at a right angle to said first filler rail portion.

7. The insert as defined in claim 6 wherein said first and second filler rail portions are resilient and extend across a corner pocket of the pool table.

8. The insert as defined in claim 7 wherein said first and second body portions include upper frustro-conical portions positioned behind said first and second rail extensions so that said upper frustro-conical portions can engage the bumper of the corner pocket when said insert is placed therein.

9. The insert as defined in claim 7 wherein said first and second filler rail portions are positioned with respect to said hinge means a horizontal distance that is less than the radius of a billiard ball so that when the ball impacts said filler rail portions, it remains in contact with the pool table top.

10. The insert as defined in claim 9 wherein said spreader means include:

a cam supported between said first and second body portions, said cam having two opposite facing lobes and torque application means; and cam follower surfaces on said first and second body portions positioned to be engaged by said cam lobes, whereby the rotation of said cam by application of torque to said torque application means pivots said first and second body portions about said hinge means.

11. An insert for plugging the pocket of a pool table and extending the rail thereacross so that games such as billiards and craps can be played on the top thereof between the rails thereof, said insert including:

first and second body portions, said first body portion having a first lower flange portion and said second body portion having a second lower flange portion;

at least one filler rail portion connected at least to said first body portion;

hinge means connecting said first and second body portions together for relative pivoting movement therebetween; and spreader means connected between said first and second body portions to pivot said first and second body portions apart about said hinge means to force said first and second lower flanges into the pocket and thereby removably retain said insert therein, said first and second flanges including upper surface portions which are in general alignment with the pool table top when said insert is being retained in said pocket and which extend the top to said filler rail portion.

12. The insert as defined in claim 11 wherein first and second filler rail portions are included, said first filler rail portion being connected to said first body portion and said second filler rail portion being connected to said second body portion positioned at a right angle to said first filler rail portion.

13. The insert as defined in claim 12 wherein said first and second filler rail portions are resilient and extend across a corner pocket of the pool table, and wherein said first and second body portions include upper frustro-conical portions positioned behind said first and second rail extensions so that said upper frustro-conical portions can engage the bumper of the corner pocket when said insert is placed therein.

* * * * *